US006438920B1

(12) United States Patent
Tobey et al.

(10) Patent No.: US 6,438,920 B1
(45) Date of Patent: Aug. 27, 2002

(54) HYBRID TRUSS AND SYSTEM OF FABRICATING WITH HYBRID TRUSS

(76) Inventors: Russel J. Tobey, P.O. Box 647, Tipton, MO (US) 65081; Jonh L. Smith, 352 Vanther, Holts Summit, MO (US) 65043

( * ) Notice: Subject to any disclaimer, the term of this patent is extended or adjusted under 35 U.S.C. 154(b) by 0 days.

(21) Appl. No.: 09/513,061

(22) Filed: Feb. 24, 2000

(51) Int. Cl.[7] ..... E04B 1/32

(52) U.S. Cl. ..... 52/639; 52/93.1; 52/93.2; 52/693

(58) Field of Search ..... 52/93.1, 93.2, 52/639, 90.2, 633, 693, 634, 731.7

(56) References Cited

U.S. PATENT DOCUMENTS

| | | | | | |
|---|---|---|---|---|---|
| 3,191,238 | A | | 6/1965 | Olson | 20/1 |
| 3,425,720 | A | | 2/1969 | Spane | 287/20.92 |
| 4,173,857 | A | | 11/1979 | Kosaka | 52/642 |
| 4,294,050 | A | | 10/1981 | Kandel | 52/93 |
| 4,559,748 | A | | 12/1985 | Ressell | 52/90 |
| 4,854,104 | A | | 8/1989 | Pomento | 52/642 |
| 4,974,387 | A | * | 12/1990 | Dufour | 52/639 |
| 5,269,106 | A | * | 12/1993 | Stafford | 52/63 |
| 5,419,089 | A | * | 5/1995 | Hill | 52/93.2 |
| 5,457,927 | A | * | 10/1995 | Pellock | 52/633 |
| 5,561,949 | A | | 10/1996 | Knoth | 52/92.2 |
| 5,660,005 | A | * | 8/1997 | Tacoma | 52/93.2 |
| 5,735,087 | A | | 4/1998 | Olden | 52/92.2 |
| 6,240,682 | B1 | * | 6/2001 | James et al. | 52/90.2 |

* cited by examiner

*Primary Examiner*—Carl D. Friedman
*Assistant Examiner*—Patrick J. Chavez

(74) *Attorney, Agent, or Firm*—Richard Grundstrom

(57) ABSTRACT

A hybrid truss and a system of fabricating a building using a hybrid truss is provided. The hybrid truss is designed to span large widths without center support. Each hybrid truss is typically made with two symmetrical truss members that join at the peak. Each member is made with an upper cord and a lower cord having cross bracing between the two cords. A peak end member is attached to the ends of the cords to join the two truss members at the peak to form the hybrid truss. Attached at the lower end of each truss member is a sleeve. The sleeve is rigidly attached to at least the lower cords and cross bracing. The sleeve redirects outward forces into the top of a post in a downward force and a slight rotational force. The sleeve is designed to slide over the top of a post or column to attach and properly position the truss on the top of the posts or columns. Vertical adjustment to level the hybrid truss is provided by vertical movement of the sleeve on the post. Once all the posts are placed, and cut to a generally level height, the hybrid trusses are lifted and placed on the posts with the sleeve fitting over the top of the posts. The sleeve, after being vertically adjusted, is secured to the the post with bolts, screws, nails or other fasteners. Backing 2×4 or 2×6's are attached across the top cord and to the outside of the posts. Roofing material and wall material are attached to the backing to enclose the building. The hybrid truss with the sleeve and this method allows a building to be constructed very rapidly and inexpensively. Site preparation is minimized, in that the land does not have to be leveled. There is no need for a concrete floor, foundation or footing. A building having a large width or span with high overhead clearance can be constructed in a very short time using the hybrid truss and the system of fabricating a building with the hybrid truss.

14 Claims, 4 Drawing Sheets

HYBRID TRUSS AND SYSTEM OF FABRICATING WITH HYBRID TRUSS

BACKGROUND OF THE INVENTION

The present invention relates to a hybrid truss and a system of fabricating with the hybrid truss and more particularly to a hybrid truss with sleeves or pockets that receive the top of wooden posts or columns. The truss of this invention provides a means of very quickly fabricating or constructing a building that covers large spans with high overhead clearance.

Generally there are two basic methods of constructing a building, post and beam, and frame. These methods generally referred to the construction of the supporting structure for the outer sides of the building. Roof structure are generally referred to as either trusses or rafters, again depending on the type of construction. Trusses are typically engineered to be supported at the ends by the structure of the outer wall frame. Trusses generally span the distance between the walls without any interior support. Rafters, on the other hand, have a center support along the roof of the building's centerline. Lumber is extended between the center support and the outer walls. Since rafters have a center support, rafters are not generally used where center openings and high overhead clearances are needed or desired.

Most building construction use trusses in one form or another for the roof. Several reason account for the wide use of trusses. Trusses are typically pre-made, so they do not have to be made at the site. This results in more uniformity in the roof structure and generally higher quality roof. Trusses can generally be placed a lot faster than rafters can be built. So the use of trusses speeds the construction of the roof. The use of trusses can also provide buildings with large center openings without center support.

There are a number of different designs and applications for trusses. This invention is directed to buildings generally classified as post and beam construction, at least as far as the primary support is concerned. However, the hybrid truss could be used in other types of construction as long as there are appropriate provisions for receiving the hybrid truss.

Generally, in post and beam type of construction vertical posts or columns are used as the primary supporting structure. Horizontal beams cross the posts to provide horizontal structure and stability, and for attachment of the wall covering. A horizontal beam is usually used at the top of the post for attaching the trusses or rafters. As such, the top of all the posts most be horizontally leveled before the attachment of the top beam or top plate, as it may be called. The ends of the trusses or rafters typically are positioned on and rests upon the top plate or top beam. It takes a considerable amount of time in most post and beam construction to level the top of the posts. This is due to the leveling of the grounds and foundation, and the building of a wall having a uniform height placed on the leveled foundation. Or if posts are used without a foundation, the tops all have to be leveled. Using the hybrid truss of this invention eliminates the need to level the top of the posts and eliminates the need for the truss to rest upon the top plate or top beam. This saves a considerable amount of time and material. The ground upon which the building is built does not need to be leveled nor does a level foundation need to be built.

Trusses are typically engineered to place the weight of the truss in a downward force on the side walls. In order to do so, there is generally a horizontal cross member to absorb the outward forced created by the weight on the peak of the roof. Trusses with a horizontal cross member eliminates the capability of having high overhead clearance without having high walls. In order to overcome this disadvantage, scissor trusses were created. Scissor trusses have the capability of creating higher center clearances, but generally cannot be used to span very large distances. Scissor trusses generally use a pair of cords which either are parallel to each other, one above the other with bracing between, or, most commonly, have a pair of cords with a greater distance between the two cords at the peak, than at the lower end. Scissor trusses also rest on the top plate or top beam of the walls. But, scissor trusses can also create an outward force on the walls. The lower cords of scissor trusses are designed to minimize the outward force by directing the force to a tension or pulling force at the junction of the lower cords at the peak. When weight of the roof sheeting and roofing material is added this force can become very high. Many scissor trusses fail at this junction.

The hybrid truss of this design uses a sleeve that is rigidly attached to one or two cords, and cross bracing on the truss. The sleeve is designed and attached to the truss to redirect forces of the cords to the post in a downward force and to reduce outward forces. The sleeves have an opening which receives the top of the posts. In this manner, the trusses are attached to the posts rather than being attached to the top plate or beam. In addition, the sleeve is constructed and attached to the overall truss structure in such a manner that the outward forces of the scissor trusses are greatly reduced and are redirected into a downward force on the posts. Since the truss of this design redirects the outward forces on the lower cords, larger spans are possible.

Accordingly, it is an object of the present invention to provide a hybrid truss, and a system of fabricating a building with the hybrid truss, adapted to save time and material during construction. With the hybrid truss and system of fabricating a building with a hybrid truss of this invention it has been found that the top plate or top beams do not have to be used and the tops of the posts do not have to be leveled. Since the sleeves receives the top of the posts, the hybrid trusses themselves are leveled rather than the top of the posts, or the top plate or beam. As a result, a considerable amount of time is saved.

Another object of the present invention is to provide a hybrid truss, and system of fabricating a building with the hybrid truss, constructed to provide buildings with a large center span with high overhead clearance. Since outward forces are redirected to the sleeve, larger spans with high overhead clearances are possible.

A further object of the present invention is to provide a hybrid truss, and a system of fabricating a building, with the hybrid truss adapted for quick and easy installation for saving time during construction. The sleeves receives the top of the posts and are attached to the posts. As such, the hybrid truss of this invention is simply lowered onto the posts, with the sleeves receiving the top of the posts, and when the hybrid truss is properly positioned and leveled the sleeve is secured to the post. Thereby, substantially saving construction time.

Still another object of the present invention is to provide a hybrid truss, and system of fabrication a building with a hybrid truss, that may be easily hauled to the construction site but yet span large open areas with a high overhead clearance. The hybrid truss and system of fabrication a building with a hybrid truss of this invention is preferably made with symmetrical sections that can be joined at the peak at the construction site. As such, trusses that span large openings with high overhead clearance are provided that can be hauled by standard trucks without violating any road size restrictions.

Another object of the present invention is to provide a hybrid truss, and a system of fabricating a building with the hybrid truss, that allows the use of steel trusses with a steel sleeve to receive the top of a wooden post or column. Typically, in the past, metal trusses were used by attaching to steel posts, or attached to wooden top plates or top horizontal beams. These systems or methods needed a considerable amount of time for leveling and alignment. The hybrid truss, and system of fabricating a building with the hybrid truss, greatly reduces the amount of time needed in these steps. The steel sleeve is simply placed over the tops of properly placed wooden posts or columns. There is no need to level the top of the posts. The sleeve is simply positioned level with the other trusses and is secured to the post, thereby saving a considerable amount of time.

To accomplish the foregoing and other objects of this invention there is provided a hybrid truss and a system of fabricating a building with the hybrid truss.

SUMMARY OF THE INVENTION

The hybrid truss, and a system of fabricating a building with a hybrid truss of this invention, provides a truss that can span large widths without a center support to create an open area having high overhead clearance and a system of fabricating or constructing a building using the hybrid truss. Each hybrid truss is made with two symmetrical members, or truss members, that join at the peak. Each member is made with two cords, which are parallel in the preferred embodiment, but can be nonparallel in some instances. The cords have cross bracing between two cords, and have a peak end member. The peak end members are used to join two truss members at a peak to form the entire hybrid truss. Attached at the lower end of each member of the truss is a unique sleeve. The sleeve is rigidly attached to the truss cords and bracing. The sleeve is designed to slide over the top of a post or column. The sleeve is used to attach and properly position the truss on the top of the posts or columns. In preparation to receive the hybrid truss, the posts are simply properly-placed, and cut to a general height. They do not need to be level across the top. The hybrid trusses are simply lifted and placed on the posts with the sleeve fitting over the top of the posts. The sleeve is then secured to the post with bolts, screws or other fasteners, once the truss is properly positioned height-wise. Backing 2×4's or 2×6's are attached across the top cord of the trusses and to the outside of the posts. Roofing and wall covering are installed on the backing.

In the preferred embodiment, the posts are wooden posts or timbers. These are embedded to a proper depth, depending on the soil conditions and loading factors of the building. Once the wooden posts are all positioned and generally cut to a height, the trusses can be properly positioned and secured to the tops of the wooden posts. A unique factor is the use of the steel sleeve on the hybrid truss and the positioning and securing the truss on wooden posts. There is no known system having this combination.

The above mentioned and other objects, and features of the present invention will be better understood and appreciated from the following detailed description of the main embodiment thereof, selected for purposes of illustration and shown in the accompanying drawings.

DETAILED DESCRIPTION

Figure 1:
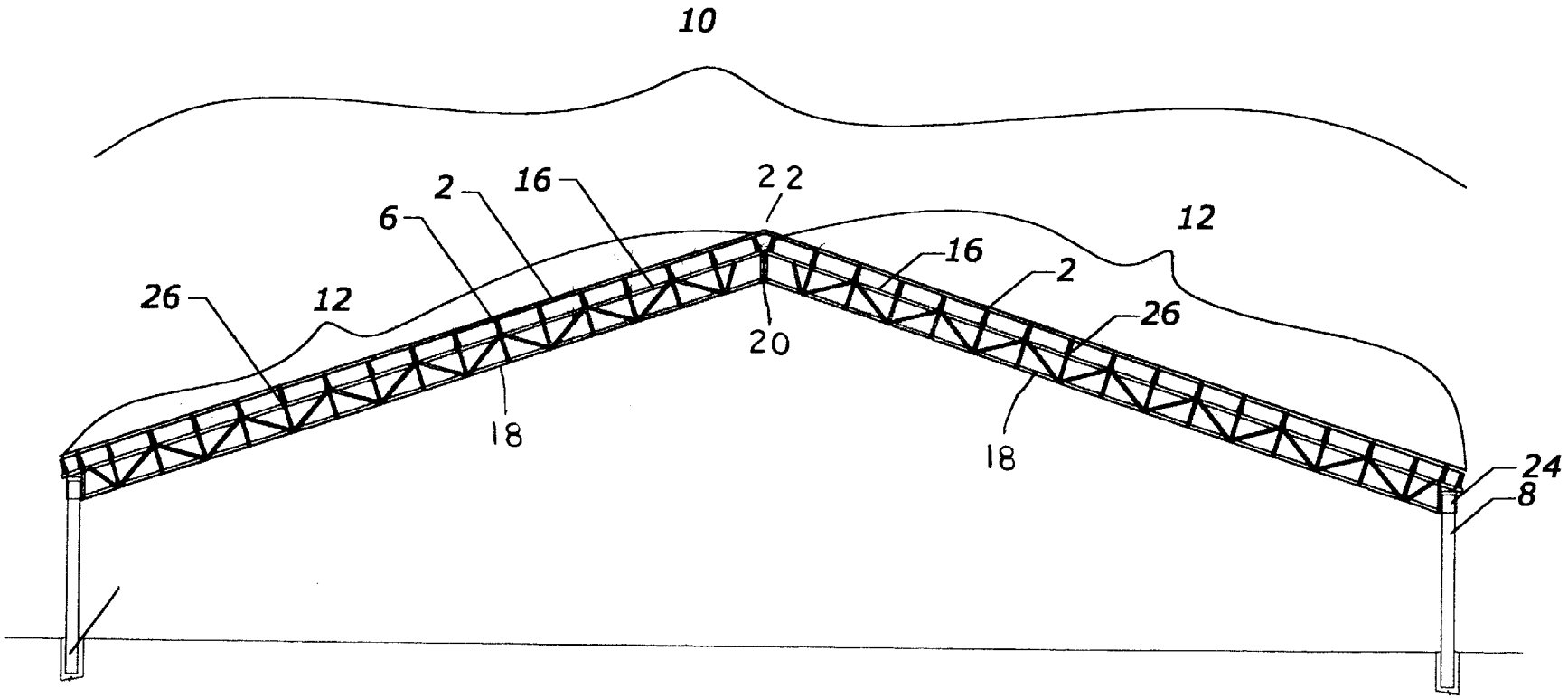
FIG. 1 illustrates the framework of a building using the hybrid truss of this invention and showing the hybrid truss and the relationship to the posts and general overview of the system of fabricating a frame for a building.

Referring now to the drawings in general there is shown one preferred embodiment for the hybrid truss 10 and system of fabricating a building with the hybrid truss of this invention.

A hybrid truss 10 is provided to span large widths without any center support to create an open area having high overhead clearance. A system of fabricating or constructing a building using the hybrid truss is also provided. Each hybrid truss 10 is made with two symmetrical truss members 12 that join at the peak 22. Each truss member 12, in a preferred embodiment, is made with a steel upper cord 16, a steel lower cord 18, cross bracing 14 between the cords 16 and 18, and a peak end member 20. The peak end member 20 on truss member 12 is used to join two truss members 12 at the peak 22 to form the entire truss 10. In the preferred embodiment, each truss member 12 has a separate peak end member 20. In another embodiment, the peak end member 20 is shared between two adjoining truss members 12.

Attached at the lower end of each member of the truss members 12 is a unique sleeve 24. The sleeve 24 is generally rigidly attached to at least the lower cord 18 and more generally to the truss cords 16 and 18, and to cross bracing 14. This arrangement, or method of attaching the sleeve, is necessary to redirect outward forces to the sleeve 24 and the truss cords 16 and 18. The sleeve 24 is designed to slide over the top of a post 8 or column. In this manner, the hybrid truss 10 can be properly height positioned (or vertically adjusted) and attached on the top of the posts 8 or columns. In the preferred embodiment of this invention, a steel sleeve 24 is used with wooden posts 8. This arrangement allows a wide range of possible uses.

Figure 3:
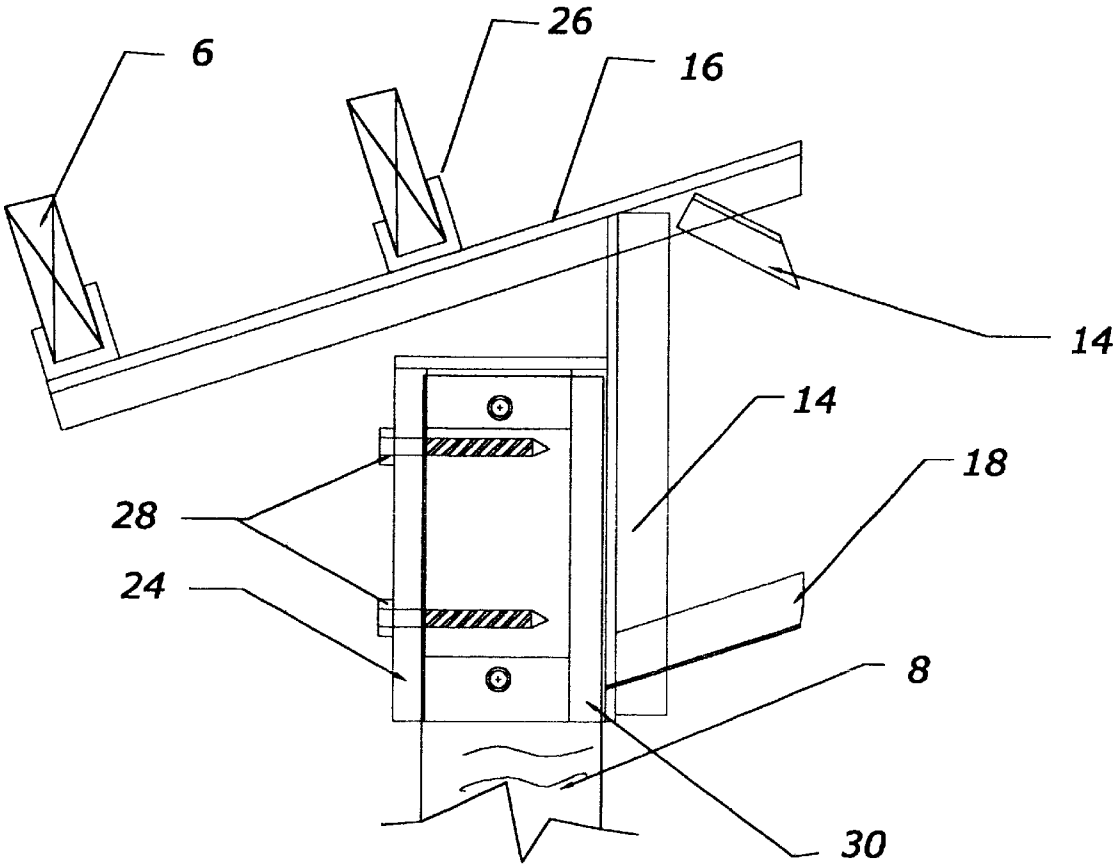
FIG. 3 is a view showing a typical sleeve at the end of the truss member attached to the top of a post or column.

To construct a building, the posts 8 are simply properly placed and embedded to the correct dept. The correct depth is determined by the soil condition and load factors to be placed on the posts. Once the posts 8 are placed, and cut, if needed, to the general height desired (but not necessarily leveled), the hybrid trusses 10 are lifted and placed on the posts 8 with the sleeves 24 fitting over the top of the posts 8. The use of the sleeve 24 on posts 8 provides for vertical height adjustment of the truss 10 and leveling of all the trusses 10 in respect to one another. Once properly height positioned or vertically adjusted, the sleeves 24 are secured to the posts 8 with bolts, screws, nails or other fasteners. FIG. 3, shows the use of lag screws 28.

Backing 6, such as 2×4's or 2×6's, are attached across the top cords 16 of the hybrid trusses 10 and along the outside of the posts 8. Brackets 26 are provided for attaching the backing 6 to the hybrid trusses 10. Once the backing 6 is attached, the building is ready for installation of the roof 2 and wall covering 4.

Provisions for bracing an entire frame structure are also provided for strength and stability. The bottom cord 18 can include openings or holes to receive angle braces to support the length of the roof backing 6 between adjacent hybrid trusses 10. This allows greater distances between the trusses 10 by reducing the length of unsupported backing 6. Openings are also provided in the trusses 10 to accommodate cable bracing. Cable bracing is used to provide stability of the posts and are also used in squaring the building frame before application of the wall covering. The use of cable bracing eliminates the laborious task of using wood bracing.

The hybrid truss 10 and this system of fabricating or construction allows a building to be constructed very rapidly and inexpensively. Site preparation is minimized, in that the land does not have to be leveled. There is no need for a concrete floor, footing or foundation. The posts 8 are simple embedded and cut to a generally level height, if necessary, and the hybrid trusses 10 are ready to install. A building using the truss and this method can be constructed in a very short time, and at almost any location.

The preferred embodiment and the best mode contemplated of the hybrid truss 10 and system of fabricating a building with hybrid truss of the present invention are herein described. However, it should be understood that the best mode for carrying out the invention hereinafter described is offered by way of illustration and not by the way of limitation. It is intended that the scope of the invention include all modifications which incorporate its principal design features.

The hybrid truss 10 is typically formed by two truss members 12 which are symmetrical to each other and joined at an upper end to form a peak 22. In the preferred embodiment, the truss members 12 and cross bracing 14 are constructed from steel tubes, steel channel and steel angle iron. Other construction material could also be used without departing from the scope and spirit of this invention, as long as the needed strength is provided and the material size is compensated as necessary for strength.

Each of the truss members 12 are made of two cords, an upper cord 16 and lower cord 18. In the preferred embodiment, the cords 16 and 18 are in a parallel spaced relationship. Cords 16 and 18 being in a parallel relationship, provides the greatest overhead clearance. However, the truss members 12 could also be made with nonparallel cords 16 and 18. In a nonparallel arrangement, the distance between the cords 16 and 18 would generally be greater near the peak 22 than at the bottom or lower end of the truss member 12.

Cross bracing 14 is provided between the two cords 16 and 18. The cross bracing 14 is necessary for strength, to hold the cords 16 and 18 in the proper spaced apart relationship and for directing forces along the cords 16 and 18. The cross bracing 14 generally create a number of triangular forms for redirecting forces and for strength. The particular number and location of the cross bracing 14, would of course, depend upon the length of the truss member 12 and the expected load capacity. The longer the span and the higher the load capacity, a higher number of cross bracing 14 and closer spacing of the cross bracing 14 would be required. This would have to be properly engineered for the specific application. However, typically a number of standard sizes would be readily available for specific size buildings. This would reduce overall cost by standardization. Specifically made hybrid trusses 10 and truss members 12 could of course be engineered for any specific and customized building requirement.

A peak end member 20 is attached to the peak end of the cords 16 and 18. The peak end member 20 is used to join one truss member 12 with another truss member 12 to make a hybrid truss 10. In a preferred embodiment, the peak end member 20 is simply a steel plate permanently attached to the peak ends of the top cord 16 and lower cord 18. A peak 22 is formed when the two truss members 12 are joined. In order to form a peak 22, the peak end of the lower truss 18 must be set inward in respect to the peak end of the upper truss 16. Generally, an acute angle is formed between the peak end member 20 and the upper cord 16 and an obtuse angle is formed between the peak end member 20 and the lower cord 18. The exact angles would be determined by the span, pitch of the roof, and whether the cords 16 and 18 are parallel or nonparallel.

Figure 2:
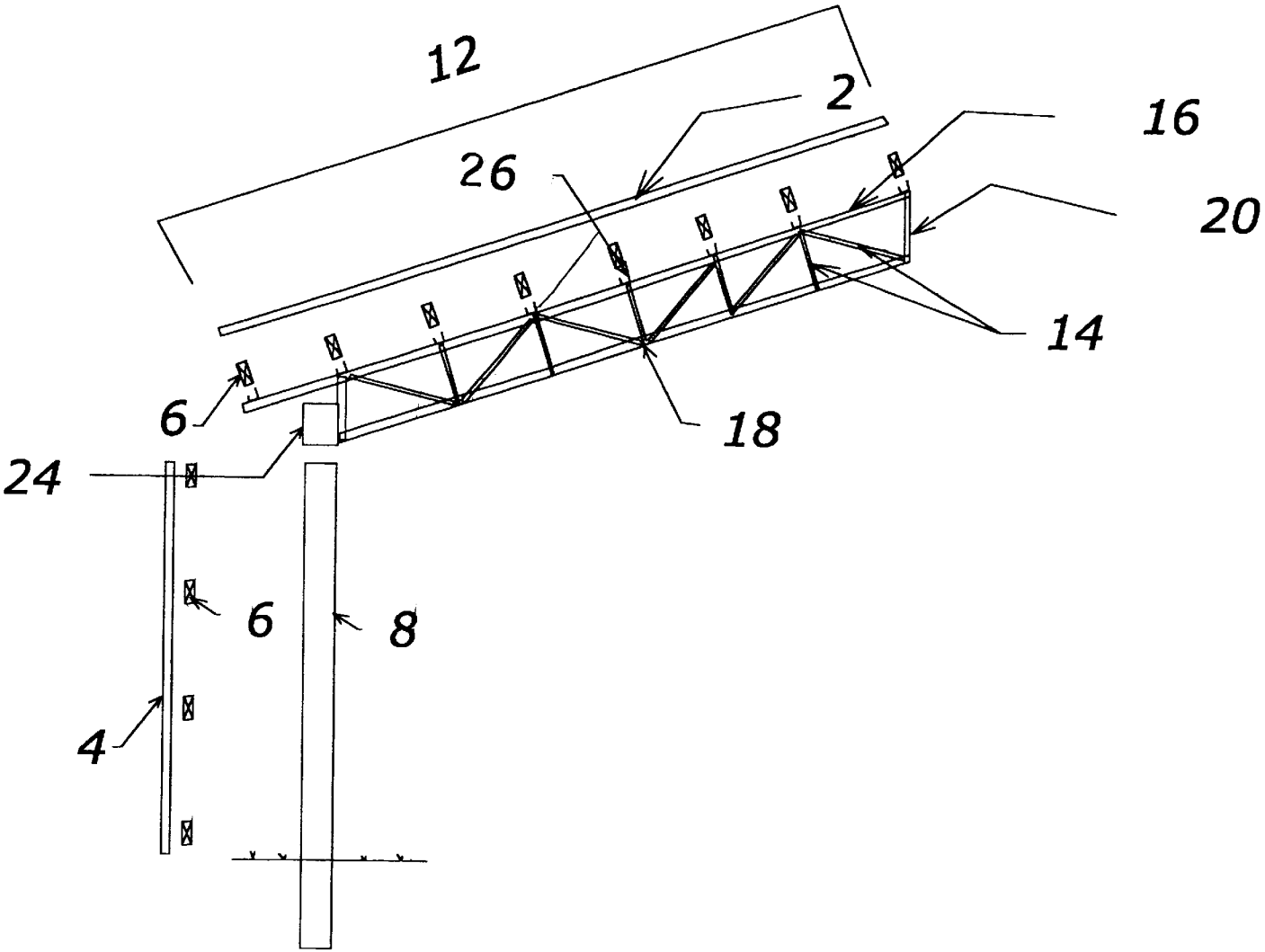
FIG. 2 is an expanded view illustrating a typical truss member showing typical bracing, a sleeve and the trusses relationship to the posts, roof covering and wall covering.

There are two general embodiments for the hybrid truss 10 formed with the two symmetrical truss members 12. The first embodiment, the complete hybrid truss 10 is formed as generally described. That is, there is a peak end member 20 at the end of each separate truss member 12, as shown in FIG. 2. This allows truss members to be hauled in a standard truck without violating any road size restrictions. In this embodiment, the truss members 12 are simply joined at respective peak end members 20 to form the complete hybrid truss 10 at the construction site. The respective peak end members 20 can be joined by bolts, screws, other fasteners or by welding as desired or as designed. Matching bolt holes would be provided, in one embodiment, for bolting the truss members 12 together.

Another possible embodiment is the complete assembly of the two truss members 12 as a single unit to form the hybrid truss 10, as shown in FIG. 1. In this embodiment, the two truss members 12 would be preassemble at a single peak end member 20. This arrangement saves time at the construction site, but reduces the capability of hauling completed hybrid trusses 10 without violating road size restrictions. In order to reduce overall costs and material, the hybrid truss 10 of this embodiment, one common peak end member 20 could be shared between the two truss members 12. In this embodiment, the top cords 16 and lower cords 18 would be joined to opposite sides of a common peak end member 20.

A sleeve 24 is attached to the lower ends of the top cord 16 and lower cord 18. The sleeve 24 has a bottom opening for receiving a top of a column or post 8. In the preferred embodiment as illustrated, the sleeve 24 is made using welded steel plating to form a sleeve 24 in the shape of the post 8 on which the truss 10 is to be attached. As illustrated, sleeve 24 is positioned on and secured to a 6-inch×6-inch post 8. However, the sleeve 24 could be made in any shape that corresponds to the shape of-the post 8. In another embodiment, the sleeve 24 is cylindrical in shape. The cylindrical sleeve 24 would of course fit over the top of a round post 8. Generally, posts 8 and columns are either square, rectangular or round in standardized sizes. As such, sleeves 24 would be available for most if not all standardized sizes and would be custom made for any other application. The sleeve 24 would of course be made of varying lengths to provide the proper load transfer to the posts as required by the height and width of the building, type of post being used and other load factors such as wind forces, weight of the building, and covering material.

The sleeve 24 is rigidly attached to the lower end of the truss members 12. Typically, in the embodiment as shown in FIG. 2, the sleeve 24 is attached to a lower cord 18 and to cross bracing 14. This is the preferred position of attaching the sleeve 24 and is generally needed for the strength of the connection and for properly redirecting forces to the post 8. A bottom surface or edge of the top cord 16 could also be attached to the top of the sleeve 24 for addition strength and stability. Typically, the lower end of the top cord 16 extends beyond the sleeve 24 to create a roof overhang along the wall. This is desirable to direct water away from the wall.

Sleeve 24 can be permanently attached to the end of truss member 12 by welding or by other methods. Or in another embodiment, the sleeve 24 can be attached by bolts. This embodiment, using attachment by bolts, allows interchangeable sleeves to be used. As such, a plurality of truss members 12 can be pre-manufactured and the appropriate sleeve 24 can be attached as needed, depending on the building, and type and size of post 8 being used.

The configuration and manner in which the sleeve 24 is attached is critical in directing the forces of the lower truss member 18. The sleeve 24 and configuration redirects the outward force to a downward force and a somewhat rotational force on the top portion of the post 8. The forces are redirected along the cross bracing 14 back and forth between the lower cord 18 and the upper cord 16. The forces terminate at the sleeve 24, where the force is directed downward similar to a standard truss with a horizontal bottom cord.

Figure 3A:
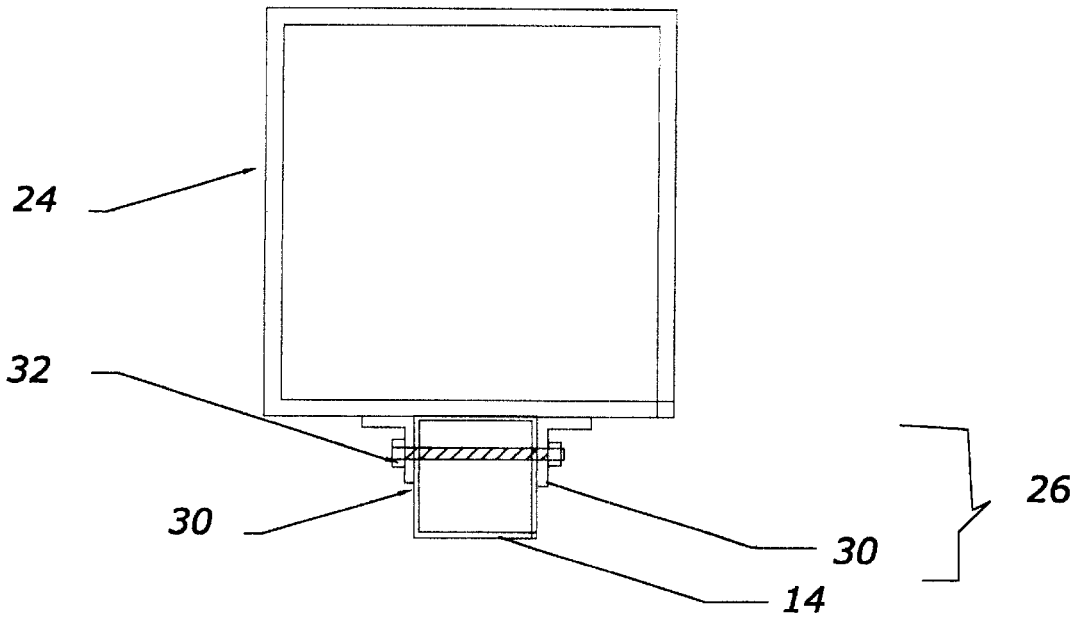
FIG. 3A is a top view showing the top of the sleeve and the lower end member configuration, to make the sleeve interchangeable.

A lower end member configuration 26 may be used for attaching the sleeve 24 to the lower end of cord 18 and to cross bracing 14. The lower end member configuration 26 can have different designs and configurations depending on the particular application and desires. As illustrated in FIG. 3A, the lower end member configuration 26 consists of a steel tube as the end cross bracing 14 to close the end of the lower end of truss member 12 and for cross bracing between the lower cord 18 and top cord 16. The steel tube is welded to the end of the lower cord 18 and extends upward and is attached to the lower surface of the top cord 16. The result is a more downward force on the post 8 and a somewhat rotational force if the junction of the peak end members 20 should fail or give at all. Two pieces of steel angle iron are used as bracket 30 which are welded or attached to sleeve 24, in a spaced apart parallel relationship, FIG. 3A. The steel tube-or cross bracing 14 on the end of the truss member 12 fits between the two steel angle irons 30. Matching bolt holes are provided in the steel tube and angle irons 30. The sleeve 24, by this method, can be simply bolted, with bolts 32, to the truss member 12 in an interchangeable fashion.

Backing 6, such as 2×4's and 2×6's, are attached to the roof trusses and posts 8 for attaching the roof 2 and wall covering 4. Typically posts 8 are made of wood, so backing 6 can be nailed or directly fastened to the posts 8. However, if the hybrid trusses 10 are made of steel, as in the preferred embodiment, the backing 6 is difficult to attach. Therefore, brackets 26 are provided. Brackets 26 are simply metal brackets with provisions for attaching the backing 6. Typically, the provisions consist of one or more holes for attaching and securing the backing 6 to the bracket 26 with nails or screws.

The above mentioned and other objectives of the hybrid truss 10 and system of fabricating a building with the hybrid truss are hereby meet, and described as a preferred embodiment and best mode contemplated. Any structure that incorporates the principal features as claimed, but not specifically illustrated or described, is considered within the scope and limitations of the invention. The scope is not limited to the specific preferred embodiment described and illustrated. Variations and expected embodiments were attempted to be described, but other deviations and embodiments not described in detail may be implemented that also fall within the general description of the invention as claimed.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A hybrid truss and system of fabricating a building with a hybrid truss comprising:

a pair of truss members, each of said truss members having an upper cord with a peak end and a lower end, and a lower cord with a peak end and a lower end, said lower cord being non-horizontal;

cross bracing between said upper and lower cords to join and hold said upper cord and lower cord in a spaced apart relationship;

at least one peak end member attached to said peak ends at ends of said upper cord and said lower cord, said peak end member used to join said pair of truss members at ends of said upper cords and said lower cords to form a complete hybrid truss and a peak thereon; and a sleeve attached to said lower end of said lower cord and said cross bracing between said cords, said sleeve having a bottom opening for receiving a top of a column or post, said sleeve providing vertical adjustment for said truss member on said post, and sleeve being securable to said post with a securing means, said upper cord of said truss member extending over said sleeve to provide protection.

2. The hybrid truss and system of fabricating a building with a hybrid truss as set forth in claim 1 further comprising backing brackets, one or more of said backing brackets attached to an upper surface on said upper cord for receiving and securing roof backing material.

3. The hybrid truss and system of fabricating a building with a hybrid truss as set forth in claim 1 in which said sleeve is attached to and secured to said top of said column or posts with bolts, screws or nails.

4. The hybrid truss and system of fabricating a building with hybrid truss as set forth in claim 1 further claiming a lower end member configuration, said lower end configuration having an end cross bracing attached between a lower end of said lower cord and a lower surface of said upper cord, and forming an end cross brace between said upper and lower cords, and having brackets on said sleeve to receive said end cross brace, said brackets and said end cross bracing having matching bolt holes to provide an interchangeable means for attaching said sleeve to said lower end of said truss member.

5. The hybrid truss and system of fabricating a building with the hybrid truss as set forth in claim 1 in which each of said truss members have a peak end member, said peak end members are joined to form a peak and a complete hybrid truss.

6. The hybrid truss and system of fabricating a building with the hybrid truss as set forth in claim 1 in which said upper cord, said lower cord, said bracing, said peak end member, and said sleeve are made of steel, and said post being a wooden post or timber embedded into the ground; one of said hybrid trusses being positioned on a pair of said posts with said sleeve receiving a top of said post, and said sleeve providing vertical adjustment on said post.

7. A hybrid truss and system of fabricating a building with a hybrid truss comprising:

a pair of truss members, each of said truss members being made of steel and having an upper cord with a peak end and a lower end and a lower cord with a peak end and a lower end;

cross bracing between said upper and lower cords to join and hold said upper cord and lower cord in a spaced apart relationship;

a peak end member attached to said peak ends at ends of said upper cord and said lower cord, said peak end members used to join said pair of truss members to form a peak and to form a complete hybrid truss; and a sleeve, said sleeve being a steel sleeve attached to said lower end of said lower cord and said bracing between said cords, said sleeve having a bottom opening for receiving a top of a column or post, said sleeve providing vertical adjustment for said truss member on said post, and sleeve being securable to said post with a securing means, said upper cord of said truss member extending over said sleeve;

whereas, a plurality of said posts are embedded into the ground and one of said hybrid truss is positioned on said tops of a pair of said posts, said hybrid truss being vertically adjusted by vertical movement of said sleeve on said post, and said sleeve being secured in a proper position on said post with a securing means; and a plurality of said posts and said hybrid trusses providing a frame for a building.

8. The hybrid truss and system of fabricating a building with a hybrid truss as set forth in claim 7 further comprising backing brackets, one or more of said backing brackets attached to an upper surface on said upper cord for receiving and securing roof backing material.

9. The hybrid truss and system of fabricating a building with a hybrid truss as set forth in claim 7 in which said sleeve is attached to and secured to said top of said column or posts with bolts, screws or nails.

10. The hybrid truss and system of fabricating a building with a hybrid truss as set forth in claim 7 in which said posts are wooden posts or wooden timbers.

11. The hybrid truss and system of fabricating a building with hybrid truss as set forth in claim 7 further claiming a lower end member configuration, said lower end configuration having an end cross bracing attached between a lower end of said lower cord and a lower surface of said upper cord, and forming an end cross brace between said upper and lower cords, and having brackets on said sleeve, said brackets and said end cross bracing having matching bolt hole to provide an interchangeable means for attaching said sleeve to said lower end of said truss member.

12. A hybrid truss and system of fabricating a building with a hybrid truss comprising:

a pair of truss members, each of said truss members being made of steel and having an upper cord with a peak end and a lower end and a lower cord with a peak end and a lower end;

cross bracing between said upper and lower cords join and holding said upper cord and lower cord in a spaced apart relationship, including an end cross brace attached between said lower end of said lower cord and a lower surface of said upper cord;

a peak end member attached to said peak ends at ends of said upper cord and said lower cord, said peak end members used to join said pair of truss members to form a peak and to form a complete hybrid truss;

backing brackets, one or more of said backing brackets attached to an upper surface on said upper cord for receiving and securing roof backing material; and a sleeve, said sleeve being a steel sleeve interchangeably attached to said lower end of said lower cord and said end cross brace between said cords, said sleeve having a bottom opening for receiving a top of a wooden post, said sleeve providing vertical adjustment for said truss member on said post, and sleeve being securable to said post with bolts, nails or screws, said upper cord of said truss member extending over said sleeve;

whereas, a plurality of said wooden posts are properly positioned and embedded into the ground and one of said hybrid truss is positioned on said tops of a pair of said posts, said hybrid truss being vertically adjusted by vertical movement of said sleeve on said post, and said sleeve being secured in a proper vertical position on said post; and a plurality of said posts and said hybrid trusses providing a frame for a building.

13. A method of providing a hybrid truss and fabricating a building with the hybrid truss, the step comprising:

embedding a plurality of posts in the ground in a parallel spaced apart relationship, determining the number and location of said posts by the size and location of the building to be built;

providing a pair of truss members to make one of said hybrid trusses, with each of said truss members having an upper cord with a peak end and a lower end and a lower cord with a peak end and a lower end, said lower cord being non-horizontal with said peak end being higher than said lower end;

bracing said upper and lower cords with cross bracing to join and hold said upper and lower cords in a spaced apart relationship;

attaching at least one peak end member at said peak ends at ends of said upper cord and lower cord of said truss members to join said pair of truss members to form a peak in said truss and to form a complete hybrid truss which can be used to span large widths, with a high overhead center clearance because of said non-horizontal lower cord;

attaching a sleeve to said lower end of said lower cord and said cross bracing between said cords on each of said truss members, said sleeve having a bottom opening for receiving a top of one of said posts, said upper cord of said truss member extending over said sleeve;

placing one of said hybrid trusses on a pair of said post with said sleeve receiving said tops of said posts;

vertically adjusting said hybrid truss on said post by vertical movement of said sleeve on said post, said vertical adjustment of said sleeve on said post providing a method of leveling said hybrid trusses in relation to one another;

securing said sleeve in a proper position on said post; and repeating these steps until all posts for the size of said building are placed and said hybrid trusses are properly positioned and vertically adjusted on all of said posts.

14. A hybrid truss having lower ends with a peak therebetween, and a system of fabricating a building with a hybrid truss comprising:

a pair of sleeves attached to said lower ends of said hybrid truss with each sleeve having an opening for receiving a top end of a post or column, said sleeve being attachable to said post or column;

truss members comprising a lower cord and upper cord with cross bracing between said lower and upper cords, said cross bracing joining and holding said upper and lower cords in a spaced relationship, said sleeves attached to an end of said lower cord and to a vertical cross bracing member at a lower end of said truss member; and at least one peak end member, said peak end member comprising a plate attached to upper ends of said upper and lower cords at a peak end of said truss member, said peak end member(s) used to attach two or more truss members with sleeves at said lower end to form said hybrid truss.

* * * * *